US006684748B2

(12) United States Patent
Mendenhall

(10) Patent No.: US 6,684,748 B2
(45) Date of Patent: Feb. 3, 2004

(54) APPARATUS FOR CUTTING OPTIMALLY SIZED FRUIT AND VEGETABLE PIECES

(76) Inventor: George A. Mendenhall, 4252 S. Eagleson Rd., Boise, ID (US) 83705

( * ) Notice: Subject to any disclaimer, the term of this patent is extended or adjusted under 35 U.S.C. 154(b) by 0 days.

(21) Appl. No.: 10/039,655

(22) Filed: Dec. 31, 2001

(65) Prior Publication Data

US 2003/0121422 A1 Jul. 3, 2003

(51) Int. Cl.[7] ..... B26D 1/09

(52) U.S. Cl. ..... 83/369; 83/370; 83/578; 83/932

(58) Field of Search ..... 83/585, 353, 356.2, 83/932, 423, 370, 369, 578, 73, 350

(56) References Cited

U.S. PATENT DOCUMENTS 3,349,905 A * 10/1967 Crawford ..... 209/586
3,732,764 A * 5/1973 Gerber ..... 83/34
3,927,330 A * 12/1975 Skorupinski ..... 290/54
4,054,970 A * 10/1977 Metzger et al. ..... 452/4
4,276,795 A * 7/1981 Rasmussen et al. ..... 83/42
4,372,184 A * 2/1983 Fisher et al. ..... 83/98
4,420,118 A * 12/1983 Gehlen ..... 241/101.2
5,335,571 A * 8/1994 Pike ..... 83/13
5,383,444 A * 1/1995 Kimura ..... 125/13.02
5,862,728 A * 1/1999 Giamello ..... 83/13
5,958,512 A * 9/1999 Krish et al. ..... 427/338
6,070,509 A * 6/2000 Lonn et al. ..... 73/34
2002/0166431 A1 * 11/2002 Benjamin et al. ..... 83/423

* cited by examiner

*Primary Examiner*—Allen N. Shoap
*Assistant Examiner*—Ghassem Alie
(74) *Attorney, Agent, or Firm*—Frank J. Dykas; Robert L. Shaver; Stephen M. Nipper

(57) ABSTRACT

An apparatus for cutting optimally sized fruit and vegetable pieces comprised of a dump chute, a trough, a conveyor, a drive means, at least one sensor, a programmable logic controller (PLC), and a cutter assembly. The apparatus is configured to receive materials from a source, load these materials onto a conveyor move these items by means of the conveyor to a cutting portion where the materials are cut into appropriate sized pieces, as determined by a programmed logic sensor based upon the input from a plurality of sensors and pre-selected criteria from a user.

17 Claims, 5 Drawing Sheets

APPARATUS FOR CUTTING OPTIMALLY SIZED FRUIT AND VEGETABLE PIECES

BACKGROUND OF THE INVENTION

1. Field of the Invention

The present invention generally relates to the art of cutting vegetable products, and more particularly relates to a device for cutting optimally sized vegetable and fruit pieces.

2. Background Information

This specification is presented in the context of cutting potatoes into optimally sized pieces. However it is to be understood that the apparatus described and claimed herein is capable of use with a variety of vegetable and fruit products, including, but not limited to, potatoes, carrots, cucumbers, pineapples, along with a host of other fruits and vegetables.

In commercial potato processing, potatoes are received into a receiving area where they are cleaned to remove excess dirt and rocks. Then, through a series of processes these potatoes are converted from raw potatoes into potato products having various desired attributes.

Certain varieties and sizes of potatoes are better suited for certain types of commercial applications. One of the most common and valuable potato products is called "french fry" potatoes. French-fries are made by a process, wherein washed potatoes are deposited into a steam cooker where the outsides of the potatoes are steamed and the potato skins are removed. These potatoes are then carried within an aqueous solution through tubing to a cutter head wherein the force of the fluid stream pushes the potatoes through the cutter head. As a result, the potatoes are cut into pieces having a desired shape or design according to the specifications and configuration of the blades on the cutter head. A more complete description of this process is found in U.S. Pat. No. 4,807,503, the teachings of which are hereby incorporated by reference. The cutter head assembly, however, only has the ability to make cuts in the potato in one direction. Thus a 3-inch potato will yield 3-inch pieces, a 4-inch potato will yield 4-inch pieces and a 10-inch potato will yield 10-inch pieces, or worse, some 1-inch pieces and a plurality of randomly sized broken potato pieces.

Under current market conditions, the ideal length for french-fries after processing through the cutter head is about four inches (4"). However, the varieties of potatoes that have the attributes best suited for french fries, such as Russet Burbanks, Nor-Golds, Rangers, and Shepodys, often grow to a length substantially larger than four inches (4"). As a result, in order to obtain optimal length potato pieces, the potatoes must be sorted or cut before entering into the french fry making apparatus.

One method for obtaining ideal sized potato pieces is to accept only 4-inch potatoes from the growers. This is impracticable, because these varieties having the desired characteristics for storage, cooking, texture, and water content generally grow longer than 4 inches. Furthermore, inherent natural differences prevent all potatoes from being one standard size.

Processors attempt to reduce the number of non-optimally sized potatoes by rejecting or paying lower prices for loads from producers that contain too great a number of oversized potatoes. In as much as most producers do this, the price of optimally sized potatoes is generally greater than the price of non-standard sized ones. The fewer non-standard sized potatoes that exist in a load of potatoes, the greater the price of that load. However, even when attempting to have all standard sized potatoes by paying a higher price, non-standard sized potatoes will be processed. Furthermore, the cost of obtaining such potatoes could prove to be commercially impracticable.

Another method for obtaining ideal sized potatoes is to mechanically cut all of the potatoes to one length such as four inches (4"). However, by engaging in such a method, the cut off portions of the potato which are not four inches (4"), are either separated and wasted, resulting in decreased efficiency and increased costs, or mixed with the ideal length cut potatoes and also processed. If they are processed as french fries, the result is an increased number of non-standard, non-ideal, therefore less valuable french fries. If they are separated and either disposed of or passed along for further processing, waste will result or increased costs will be incurred.

Another method for obtaining ideal sized potatoes is to employing people to manually view and cut the potatoes into as many optimally sized pieces. This process is slow and expensive.

Attempts have been made in the past to construct machines which cut oversized potatoes in half, most of which have been technically successful, to one degree or another, in achieving this goal. However, these methods have been commercially unsuccessful because of the inevitable result that some half-pieces will be too short, and others too long.

In as much as processors attempt to reduce the number of non-optimally sized potatoes by rejecting or paying lower prices for loads from producers that contain too great a number of oversized potatoes, the price of optimally sized potatoes is greater than the price of potatoes of a non-standard size. A processor with the ability to process large potatoes by cutting them into optimally sized pieces would have an advantage over its competitors. That processor could buy non-ideally sized potatoes at a decreased price from the producer, process these potatoes with less waste and obtain a premium product for which they could obtain a better price. A competitor, to obtain the same result, would have to pay the premium price for smaller potatoes, cut these potatoes, and waste the non-ideal sized potato pieces. The cost to such a competitor would place it at a significant disadvantage to the processor who could obtain ideally sized product.

Accordingly, it is an object of the invention to provide an apparatus and means for cutting optimally sized fruit and vegetable pieces. Furthermore, it is an object of the invention to provide a method for cutting optimally sized fruit and vegetable pieces from non-standard sized fruit and vegetables in a mechanized environment. It is also an object of the invention to provide a method and apparatus for cutting optimally sized potato pieces from non-standard sized potatoes.

SUMMARY OF THE INVENTION

These objects are achieved using an apparatus for cutting optimally sized fruit and vegetable pieces, such as potatoes, that is made of a frame, a dump chute, a trough, a conveyor having paddles forming paddle pockets, a drive means, at least one sensor, a programmable logic controller (PLC), and a cutter assembly. The dump chute with a heel stop is pivotally connected to the frame and receives potatoes and loads them singly on to a conveyor within a paddle pocket defined by two paddles disposed along the conveyor, and located within said trough. The drive means moves the conveyor, which then advances the potatoes from the dump chute toward the cutter.

As the potatoes move along the trough, the sensor determines the first and second ends of the potato and inputs this information to the PLC. This PLC has a human interactive component for selecting the criteria to be used in selecting the dimensions of the desired potato pieces to be obtained. The PLC receives the information from the sensors, applies an algorithm based upon pre-selected dimensions to be obtained and determines the number and sizes of the pieces that the potato should be cut into to achieve the optimal results based upon the pre-selected criteria. This information is then passed to the cutter.

The cutter receives input from the programmable logic controller. Then, it makes the directed number of cuts necessary to obtain the predetermined number of optimally sized potato pieces. The potato pieces then pass along to other areas for further processing.

Still other objects and advantages of the present invention will become readily apparent to those skilled in this art from the following detailed description wherein I have shown and described only the preferred embodiment of the invention, simply by way of illustration of the best mode contemplated for carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
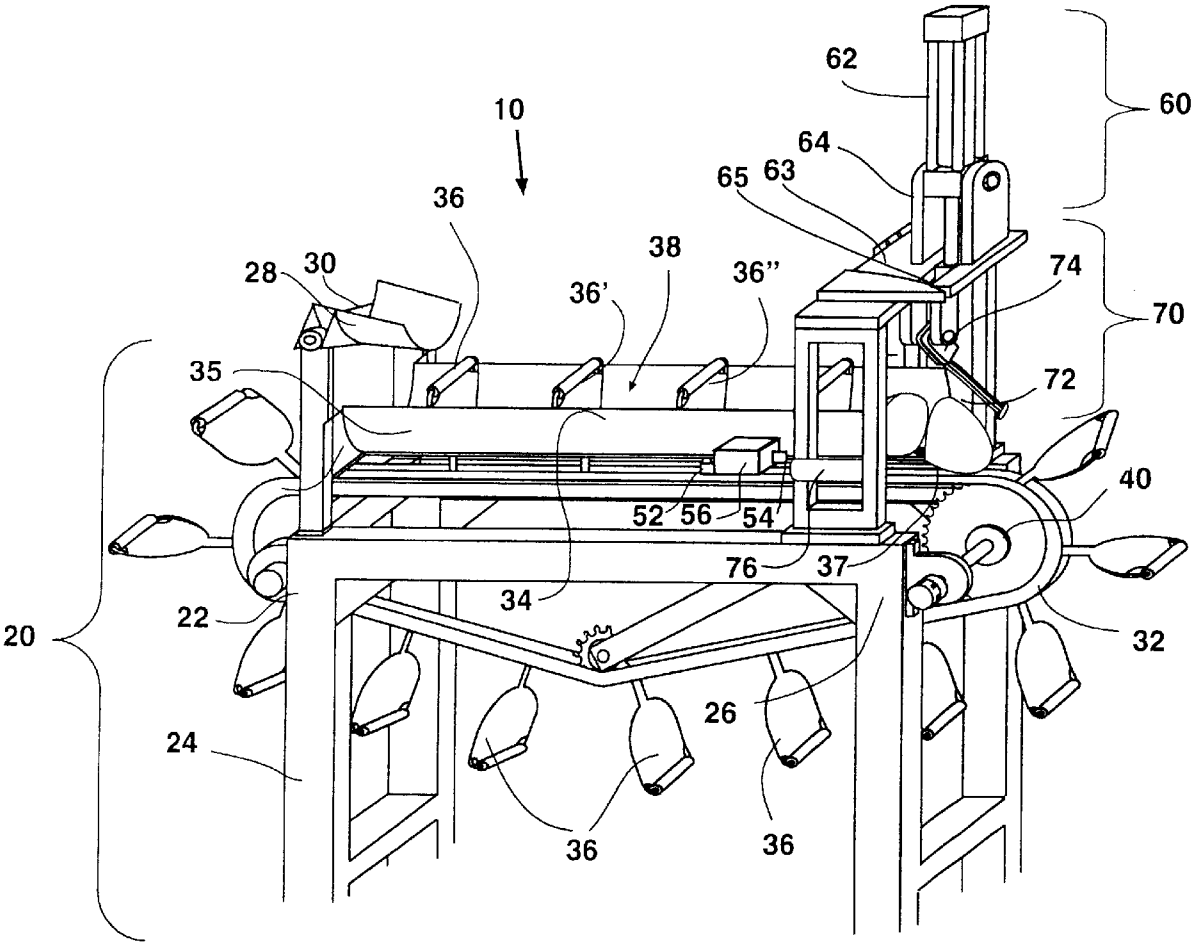
FIG. 1 is a perspective representational view of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

As previously stated, this invention is presented and described in this description in the context of cutting potatoes. However it should be apparent to those skilled in the art that the invention described herein can easily be adapted or modified to cut other fruits and vegetables, for example carrots, cucumbers, pineapples, bananas and the like. Modifications would include dimensional sizing, conveyor speed, the cutting assembly and perhaps whether the conveyor is temporarily stopped during cutting operations.

Referring now to FIG. 1, shown is an embodiment of the invention adapted for cutting optimally sized potatoes. This apparatus 10 is comprised of a frame 22 having a frame first end 24 extending to a frame second end 26. A dump chute 28 with a heel stop 30 is pivotally connected to said frame 22 and loads material such as potatoes into trough 34. Trough 34 has a trough first end 35 and trough second end 37 connected to the frame 22 and lies in a generally linear orientation. A conveyor 32, having a plurality of equally spaced paddles 36 attached thereto, and extending outwardly from the conveyor 32, is adapted to fit within the trough 34 and is attached to a drive means 40 whereby the movement of conveyor 32 rotates the paddles 36 up and through trough 34 from the first end 35 to the second end 37. The drive means 40 can be any means of driving a conveyor 32.

The space between the paddles 36 is a known distance. The space between them form pockets as shown in FIG. 1, wherein paddles 36', 36" form a pocket 38 adapted for receiving a fruit or vegetable such as a potato from dump chute 28. For definitional purposes, each paddle 36 serves a dual function with respect to the sequence of pockets, namely each paddle serves as the rear paddle of one pocket, and as the front paddle of the next pocket.

A programmable logic controller (PLC) 56 is provided. One input includes an input signal representing the speed of conveyor 32. If the speed on the conveyor is fixed, this is a known input. Another input includes location of each of the paddles 36 as each individual paddle passes sequentially by sensor 52. Other inputs for the PLC could exist with slight modifications. A programmable logic controller (PLC) was selected for use in the preferred embodiment, however it should also be apparent to those skilled in the art that other computing devices may be used.

In the preferred embodiment, sensor 52 is a magnetic proximity sensor, however it is to be recognized that there are a plurality of various proximity sensors which could be used in alternative embodiments of this invention, including light sensors and even mechanical sensors, all of which are known in the prior art.

Dump chute 28 is synchronized to move in relation to paddles 36 on conveyor 32 to ensure that one piece of material, such as a potato, falls into each paddle pocket 38. While in this embodiment the dump chute 28 is activated pneumatically or electronically it is to be understood that any other means for activation such as mechanical or hydraulic may also be utilized.

When dump chute 28 is in a dumping position, the material, while in a conventional hopper (not shown), which feeds dump chute 28 from behind the dump chute 28, is prevented from advancing into dump chute 28 by the heel stop 30, which is attached to dump chute 28. When the dump chute 28 returns to its loading position, which in the preferred embodiment is a horizontal position, the next piece of material enters over the heel stop 30 and is then dumped into the next paddle pocket 38. Heel stop 30 on the dump chute ensures that only one piece of material is placed in each paddle pocket 38. Trough 34 is formed in a generally 'V' configuration and sized for the particular material to be cut so as to frictionally engage the material to the sides of trough 34 to a sufficient degree to retard movement of the material within trough 34 until it is engaged and pushed by the rear paddle 36 of pocket 38 into which it has been dropped.

A second sensor 54 is provided to detect the leading edge of the food product in each pocket 38 as it approaches swing blade cutter assembly 70. Since the speed of conveyor 32 is a known input as well as both the distance between paddles 36 and the location of a particular paddle 36 passing by sensor 54, when sensor 54 senses the initial presence of the leading end of the material, a signal, representing the time interval between the passage of the first, or front paddle forming pocket 38 and the front of the piece of material to be cut, can be generated. This signal will be inversely proportional to the length of the piece of material. That is to say, the shorter the time interval, the longer the piece of material, in this case, a potato is. Thus, computing means in this case a programmable logic controller processor 56 is capable of determining the length of each piece of food product in each pocket 38 as it approaches swing blade cutter assembly 70. In the preferred embodiment, first sensor 52 is positioned to identify the passage of the forward paddle of a pocket 38 while second sensor 54 senses the location of the forward edge of the food product contained within that particular pocket 38. It should be apparent to those skilled in the art that there may be other suitable locations for each sensor, or that their functions may be combined in a single sensor.

Programmable logic controller (PLC) 56 then selects a pre-programmable mathematical formula to cut the pieces of material into optimally sized portions for desired recovery. This programmable logic controller 56 has human interactive capabilities that allow the criteria for the desired sizes of pieces to be selected. These parameters can be changed according to the needs of the processor. Programmable logic controller 56 then passes the information regarding the cuts to be made to control means 60, in this instance an air powered actuator. Control means 60 receives input from programmable logic controller 56 and activates the cutting assembly 70 to make the number of cuts necessary to obtain the predetermined number of optimally sized potato pieces. Any device with the ability to perceive information and make cuts according to that input may be used as a control means and a cutting means. Guillotine type knives, band or rotary saws or other types of cutting devices may be appropriate depending upon the type of food product being cut.

The type of cutting blade selected would depend on the type of food product being cut, the required production rate and whether the conveyor will be temporally stopped during the cutting process, or whether it will continue moving during the cutting process. As is later described in this specification, the type of cutter blade assembly selected for use with potatoes is a swing blade, which cuts in both directions. This speeds up the cutting process since the swing blade will not have to return to a reset position after each cut is made.

In use in a potato processor, optimally sized pieces range from three (3") to four-inches (4") in length. Therefore, programmable logic controller 56 makes a decision based upon the length of the potato as to how many optimally sized pieces within that three (3") to four inch (4") range may be produced for any given length of uncut potato. For example, for a ten inch (10") potato, the inputs from sensors 52 and 54 would enable programmable logic controller 56 to determine and then calculate, based upon a preprogrammed algorithm, what cuts would need to be made so that the maximum number of optimally sized potato pieces would be produced. The potato could then be cut into two (2) three inch (3") sections and one (1) four inch (4") section; or into two (2) three and a half inch (3½") sections and a three inch (3") section depending upon the criteria desired and chosen by the operator. Each potato would then be measured and cut to obtain the maximum number of optimally sized potato pieces based upon the size of the potato and the pre-selected criteria. Potatoes that are under length are passed without cutting at all and are fed directly into the subsequent potato processes. This may include passing, without cutting, some less than ideal sizes, such as five-inch (5") potatoes. In some situations it would be better to have an uncut five inch (5") potato rather than one four inch (4") piece and a one inch (1") piece of scrap. In any event, in the preferred embodiment, these are decisions left to the discretion of the processor.

Figure 2:
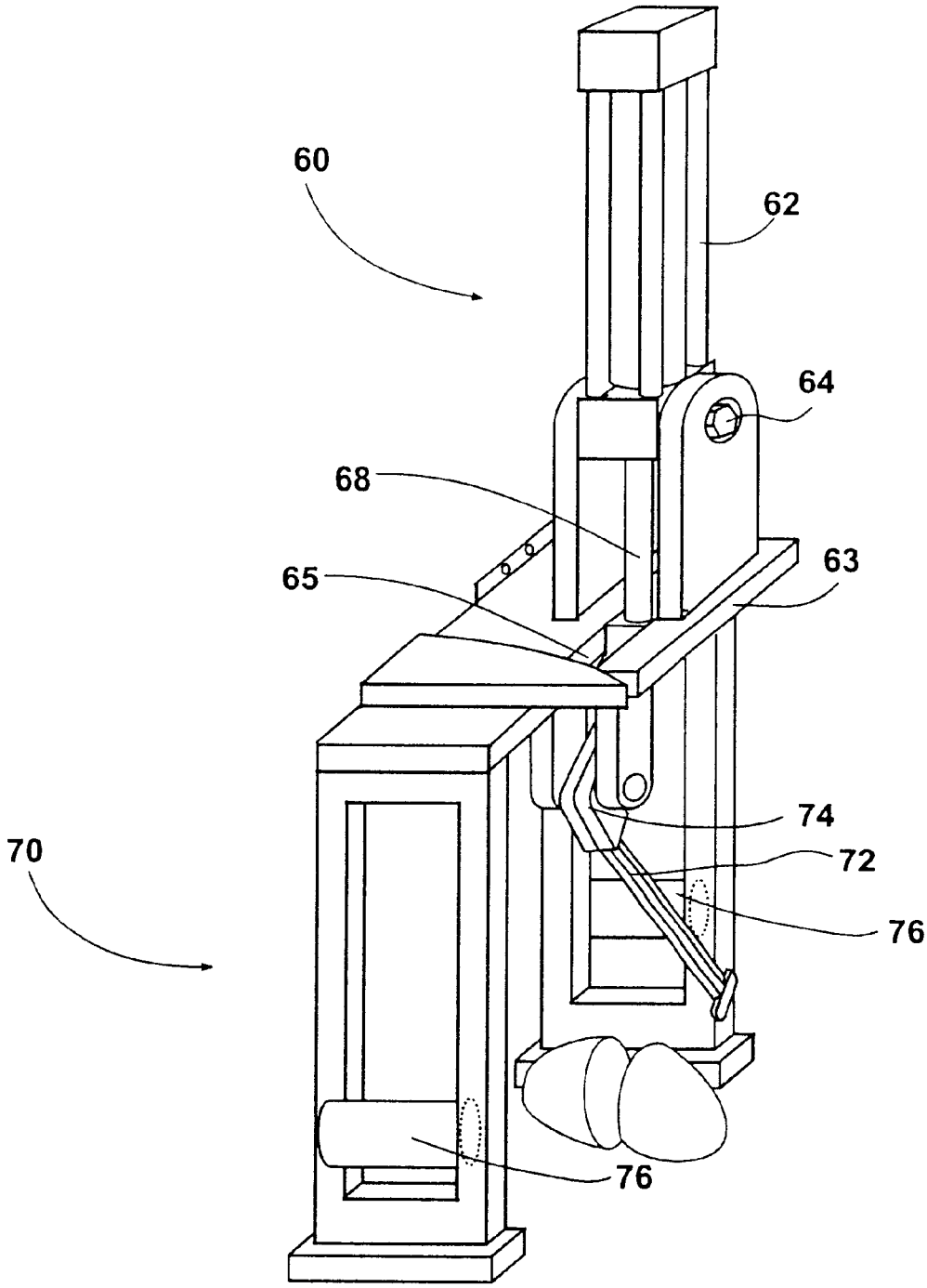
FIG. 2 is a perspective representational view of the cutter assembly and swing blade.
Figure 3:
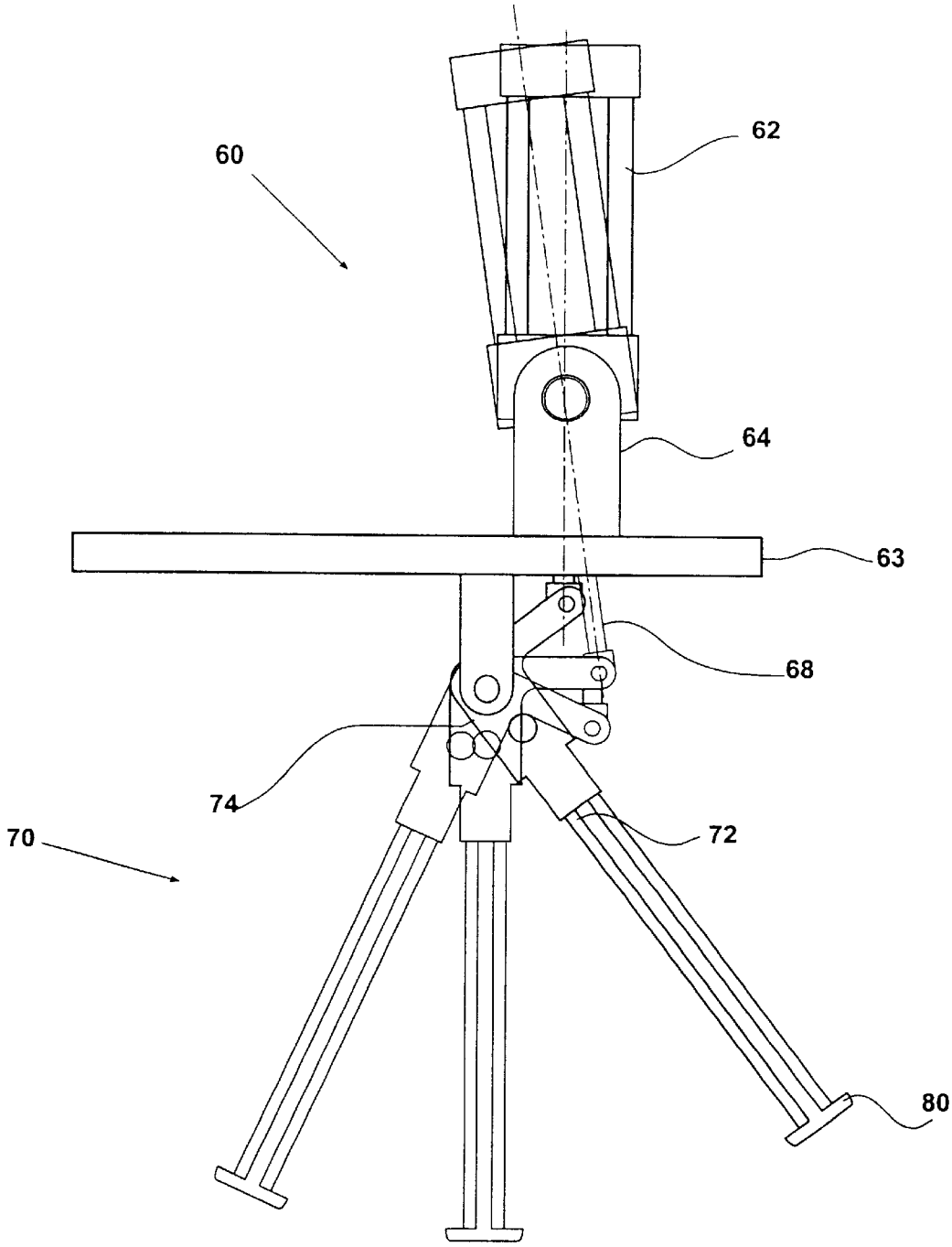
FIG. 3 is a front view of the cutter assembly and swing blade.

Referring now to FIGS. 2 and 3 a detailed view of the cutter assembly 70 and control means 60 of this preferred embodiment is shown. In this embodiment, control means 60 is provided with dual action, high pressure, fast action, pneumatic cylinder 62, hereinafter referred to as actuator cylinder 62, pivotally mounted to pivot mount 64 which itself is attached to mounting frame 63. An actuator cylinder rod 68 extends through mounting frame aperture 65 and is pivotally attached to knee joint 74 that is connected to a double-edged swing blade 72. In practice, a dual action, high pressure, fast action, pneumatic cylinder can, using air at eighty (80) p.s.i.g., can swing swing blade 72 through and cut a potato piece in approximately thirty (30) milliseconds, thus eliminating the need to temporarily stop conveyor 32 to facilitate a straight cut of the potato. While conveyor 32 is still moving as the cut is being made, the cut is made so quickly that, even though it will be slightly angled because the potato is still moving during the cutting process, it will be within acceptable limits for potato processing.

Referring now back to FIG. 1, when the actuator cylinder 62 receives input from programmable logic controller 56, it moves swing blade 72 from whatever side it is on to the other. Two-sided swing blade 72 is specially designed so that a cut can be made on both the forward and reverse movement of the blade. Upon activation from programmable logic controller 56, actuator 62 activates the knife blade 72 to swing and make the desired number of cuts at the desired distances, thus producing the desired number of optimally sized pieces.

Blade sensor 76 determines when and if swing blade 72 has made the appropriate cuts. If blade sensor 76 does not sense that swing blade 72 has made an appropriate cut, it then sends an error message to the programmable logic controller 56. If the operator so desires, the program can be altered to stop or alarm when a problem is noted.

In use in a potato-processing context, potatoes to be cut are deposited in a hopper, preferably a hopper that can be agitated, and are dumped into dump chute 28. As previously stated, these hoppers are well known in the art and play no part in the present invention. As each potato enters dump chute 28, it is deposited into a paddle pocket 38. Each potato frictionally engages the sidewalls of trough 34 and thus it is temporarily retarded until it engages the rear paddle 36' at which time the potato is pushed along through trough 34. First sensor 52 determines when the forward paddle forming the paddle pocket passes a reference point and second sensor 54 determines the time interval from that point in time until the forward end of the potato passes a second reference point. This information is transmitted to programmable logic controller 56. Programmable logic controller 56 determines the length of the potato, and the number and location of cuts to be made to obtain optimal results. Conveyor 32 continually moves each potato through trough 34. At the end of trough 34, cutter assembly 70 cuts each potato into the number of optimally sized pieces as determined by programmable logic controller 56. The optimally sized potato pieces then pass along for further processing. The results of this process are maximum numbers of optimally sized potato pieces regardless of whether or not the potatoes at the beginning of the process are optimally sized.

In practice, using four of the disclosed conveyor and cutting assemblies, ganged together, for cutting potato pieces, production rates of approximately 28,000 pounds per hour can be achieved.

Figure 4:
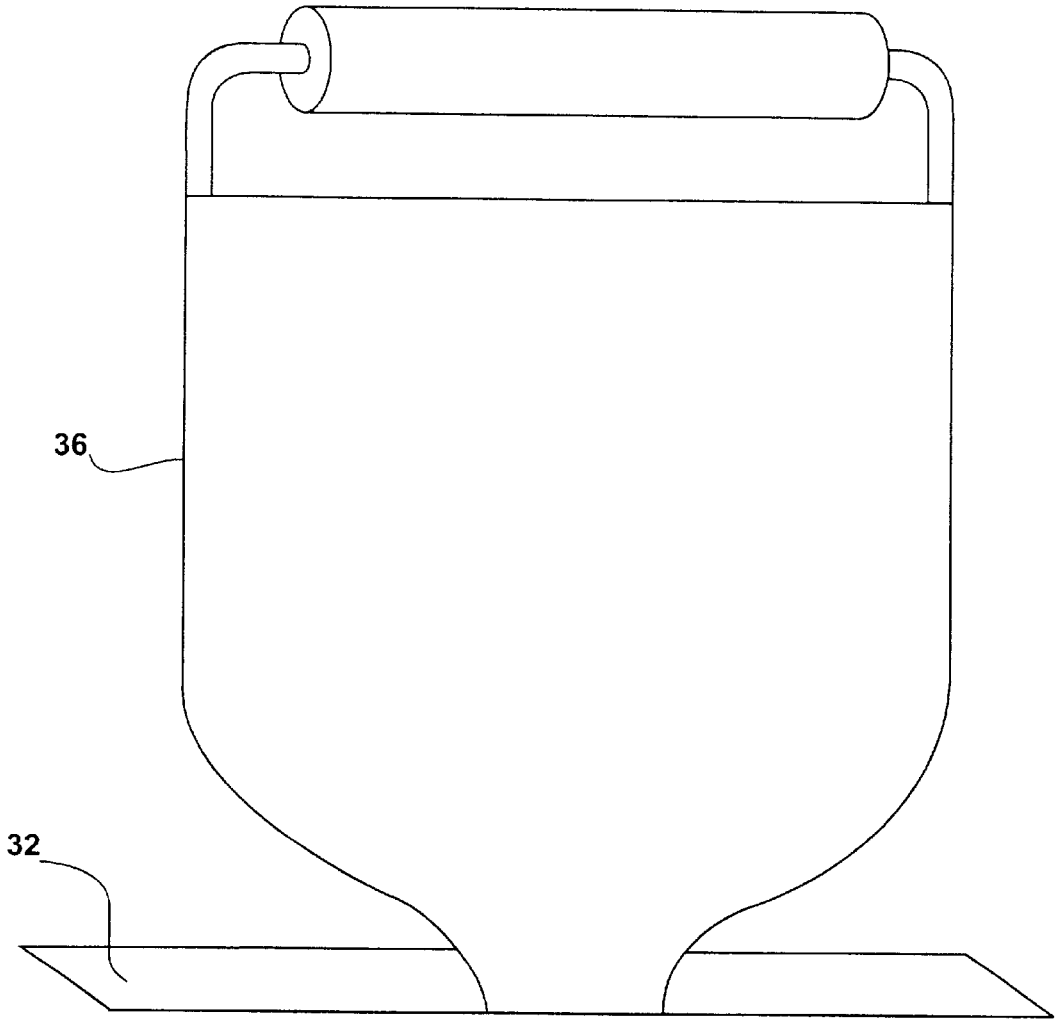
FIG. 4 is a front plan view of a paddle
Figure 5:
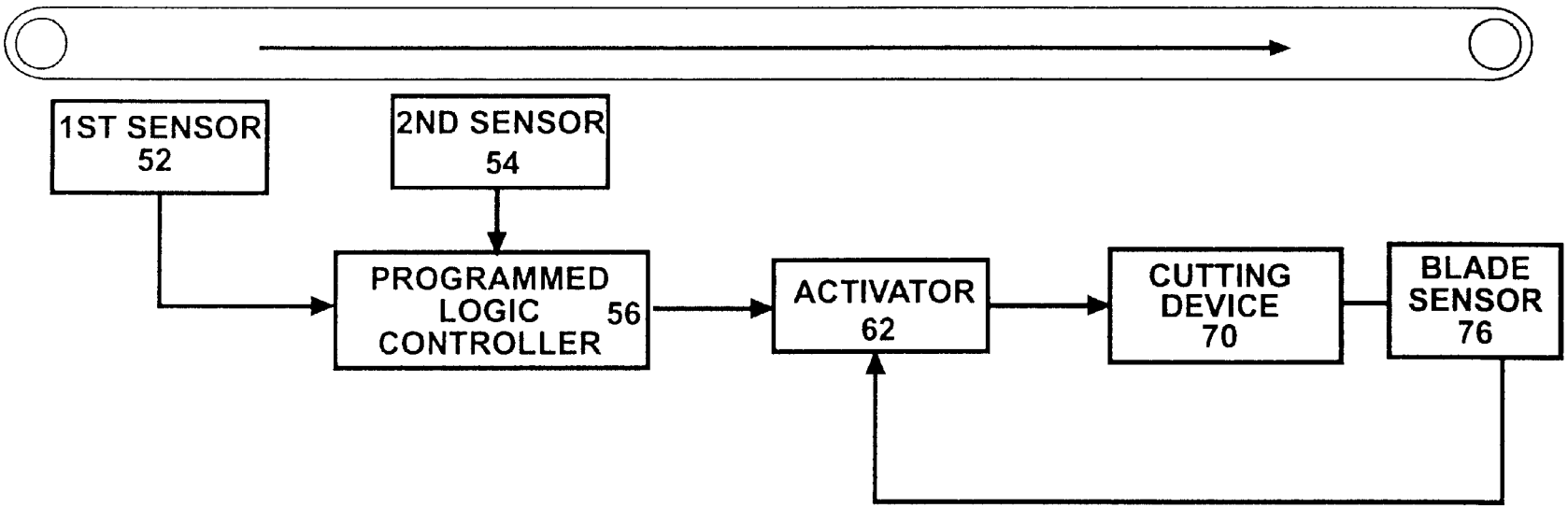
FIG. 5 is a representational view of the flow of information between sensors and control devices as a conveyor moves

In order to achieve optimal results potatoes must lay flat within each paddle pocket 38. In the case of potatoes, if a potato enters pocket 38 at too steep an angle it may land in pocket 38 with an end up against the rear paddle 36 of the pocket and the frictional contact of the potato with the trough 34 may hold the potato up. To prevent this standing up and as is shown in FIGS. 1 and 4, each paddle is provided with a roller assembly 46 which is larger in diameter than the thickness of paddle 36 to facilitate the use of the momentum of the potato being dumped into pocket 38 to help deliver the potato to the pocket in a flat orientation. This process is further enhanced by tilting paddles 38 forward about seven degrees (7°) from perpendicular engagement conveyor 32.

While there is shown and described in the present preferred embodiment of the invention, it is to be distinctly understood that this invention is not limited thereto, but may be variously embodied to practice within the scope of the following claims. From the foregoing description, it will be apparent that various changes may be made without departing from the spirit and scope of the invention as defined by the following claims.

I claim:

1. A cutter for use in cutting fruits and vegetables comprising:

a double-edged knife, having a first end portion adapted for attachment to an actuating means, and extending to a second end portion along a generally linear blade, having a right side and a left side, said right side and said left side each having a cutting portion; and an actuator; having a connecting attachment and a body pivotally mounted to a base plate defining an aperture therein for allowing the passage of a portion of said actuator, said connecting attachment pivotally connected to said double-edged knife through a knee joint.

2. A paddle for use in a conveyor having at least one paddle said paddle comprising:

a base portion adapted for connection to a conveyor;

a blade portion having a top and a bottom; and a roller attached to the top portion of said paddle blade portion;

wherein when said paddle is connected to said conveyor at said base portion, the bottom of said blade is angledly connected to said base plate, said top of said blade having a roller is positioned for contacting a potato when entering said trough from said dump chute and facilitates positioning an object along said conveyor.

3. An apparatus for cutting fruits and vegetables into optimally sized pieces comprising:

a conveyor assembly configured to convey fruits and vegetables along a predetermined path into a cutter assembly, at least one sensor configured to sense a pre-selected portion of one of said fruits or vegetables and to transmit information from said sensor to a computing device:

said computing device configured to interpret said information from said sensors to determine a length of said fruit or vegetable piece and to determine a number of cuts and a distance between said cuts required to obtain optimal desired lengths of pieces of cut material from said fruits and vegetables; and a control device operably interconnecting said computing device to said cutter assembly, said control device configured to operate said cutter assembly to cut each vegetable as required for obtaining the optimal desired lengths of pieces of cut vegetables, said cutter assembly comprised of a swinging knife configured to cut said fruits and vegetables into pieces having desired lengths.

4. The apparatus of claim 1 wherein said conveyor assembly further comprises a plurality of pockets, each of said pockets sized for receiving a fruit or vegetable and spatially positioned along said conveyor assembly for conveying vegetables to said cutter assembly.

5. The apparatus of claim 4 which further comprises means for depositing and positioning a vegetable within each of said pockets in a position wherein at least one portion of each of said fruits or vegetables is positioned in a known reference position within each of said pockets.

6. The apparatus of claim 4 wherein said conveyor assembly further comprises a plurality of paddles attached to, extending up from, and spatially positioned equidistantly along said conveyor means to define said plurality of pockets between pairs of paddles, each of said pockets relatively defined by a front panel and a rear paddle for each pocket.

7. The apparatus of claim 6 which further comprises means for depositing and positioning a vegetable within each of said pockets in a position wherein at least one portion of each vegetable is positioned in a known reference position within said pockets.

8. The apparatus of claim 7 wherein said means for depositing and positioning a vegetable within each of said pockets in a position wherein at least one portion of each vegetable is positioned in a known reference position within said pockets further comprises a trough adapted to receive said paddles, said trough extending up from said conveyor means therethrough, said trough configured to frictionally engage said vegetables in said pockets with sufficient force to drag said vegetables within said pockets to a position wherein one end of each of said vegetables is positioned against the rear paddle of each pocket.

9. The apparatus of claim 8 wherein said paddles each comprise: a paddle blade having a top and a bottom wherein said paddle blade bottom is angledly positioned with regard to conveyor and said paddle blade top is configured to facilitate positioning a fruit or vegetable said piece of material within said paddle pocket.

10. The apparatus of claim 9 wherein said conveyor assembly further comprises a dump chute with a heel stop pivotally attached to a frame whereby said heel stop prevents more than one piece of material from being placed within a single paddle pocket along said conveyor means at a time.

11. The apparatus of claim 1 wherein said conveyor assembly comprises a frame having a first end extending to a second end, a dump chute with a heel stop pivotally connected to said frame first end, a trough connected to said frame and extending from said frame first end to said frame second end in a generally linear direction, said trough adapted to receive a conveyor therethrough; said conveyor having a plurality of equally sized pockets defined by a forward paddle and a rearward paddle, each paddle spatially positioned equidistant along said conveyor and comprising a base plate, a blade having a top with a roller and a bottom; said paddles and rollers for depositing and positioning a vegetable within each of said pockets in a position wherein at least one portion of each vegetable is positioned in a known reference position within each of said pockets; said trough further configured to frictionally engage said fruits and vegetables in said pockets with sufficient force to drag said fruits and vegetables within said pockets to a position wherein one end of each of said fruits and vegetables is positioned against the rear paddle of each pocket.

12. The apparatus of claim 1 wherein said sensing means comprises a first sensing means for locating and indexing a first end of a vegetable conveyed along said conveyor and a second sensing means for locating a second end of said vegetable.

13. The apparatus of claim 1 wherein said computing means comprises a programmable logic controller having human interactive capability for determining the length of said vegetable, the number of cuts and the distance between cuts required to achieve optimally desired lengths of pieces of cut vegetable material based upon pre-selected criteria, and inputs from said sensing means.

14. The apparatus of claim 1 wherein said control means comprises a pivotally mounted pneumatic actuator, operably interconnecting said computing means to said cutter assembly.

15. The apparatus of claim 1 wherein said cutting assembly comprises a two-edged swinging blade having a first end portion adapted for pivotal attachment to an actuating means by a knee joint and extending along a body portion to a second end portion along a generally linear plane, said body portion having a left side and a right side and beveled along both the left side and the right side to form a cutting surface on both said left and said right sides; said cutting assembly further comprising a blade sensor which senses the location of said swing blade and if the appropriate number of cuts have been made.

16. An apparatus for cutting fruits and vegetables into optimally sized pieces comprising:

a conveyor assembly configured to convey fruits and vegetables along a predetermined path into a cutter assembly, said conveyor assembly having a frame with a dump chute having a heel connected thereto said dump chute configured to dump a desired fruit or vegetable into a pocket defined upon a conveyor by a plurality of paddles;

at least one sensor configured to sense a pre selected portion of one of said fruits or vegetables and to transmit information from said sensor to a computing device; said computing device configured to interpret said information from said sensors to determine a length of said fruit or vegetable piece and to determine a number of cuts and a distance between said cuts required to obtain optimal desired lengths of pieces of cut material from said fruits and vegetables; and a control device operably interconnecting said computing devices to said cutter assembly, said control device configured to operate said cutter assembly to cut each vegetable as required for obtaining the optimal desired lengths of pieces of cut vegetables, said cutter assembly comprised of a double edged swinging knife having a first end portion attached to an actuator means and extending to a second end portion along a generally linear blade, said cutter assembly configured to cut said fruits and vegetables into pieces having desired lengths.

17. An apparatus for cutting optimally sized vegetable from fruits and vegetables having a first end and a second end comprising:

a conveyor assembly for conveying vegetables along a predetermined path to a cutter assembly said conveyor assembly comprised of a frame having a first end extending to a second end, a dump chute with a heel stop pivotally connected to said frame first end; a trough connected to said frame and extending from said frame first end to said frame second end in a generally linear direction, said trough adapted to receive a conveyor therethrough; said conveyor having a plurality of equally sized pockets defined by a forward paddle and a rearward paddle, each paddle spatially positioned equidistant along said conveyor and comprising a base plate, a blade having a top with a roller and a bottom; said paddles and rollers for depositing and positioning a vegetable within each of said pockets in a position wherein at least one portion of each vegetable is positioned in a known reference position within each of said pockets; said trough further configured to frictionally engage said vegetables in said pockets with sufficient force to drag said vegetables within said pockets to a position wherein one end of each of said vegetables is positioned against the rear paddle of each pocket;

a first sensing means for locating and indexing a first end of a vegetable conveyed along said conveyor, a second sensing means for and for locating a second end of said vegetable a programmable logic controller having human interactive capability for determining, the number of cuts and the distance between cuts required to achieve optimally desired lengths of pieces of cut vegetable material based upon pre-selected criteria, and inputs from said sensing means;

control means, comprised of a pivotally mounted pneumatic actuator, operably interconnecting said computing means to said cutter assembly for operating said cutter assembly to cut each vegetable as required for obtaining the optimal desired lengths of pieces of cut vegetable; and said cutter assembly comprised of a double-edged swing blade knife connected to said cutter though a pivoting knee joint and a blade sensor for determining if the appropriate cuts have been completed;

wherein a vegetable enters said dump chute and is singly loaded into said pocket within said trough, said conveyor brings said vegetable to said cutter assembly, passing said first sensing means which locates and indexes a first end of said vegetable and passing said second sensing means which locates said second end of said vegetable, and transmits information to said programmable logic component, said programmable logic controller determines the number and location of cuts to be made to obtain optimally sized pieces based upon inputs from the sensors and pre selected criteria, said programmable logic controller transfers information regarding the number and location of cuts required for obtaining the optimal desired lengths of pieces of cut vegetable to said actuator, said actuator then moves said swing blade to make said cuts to obtain the optimal desired lengths of pieces of cut vegetable.

* * * * *